US008752683B2

(12) United States Patent
Scicluna

(10) Patent No.: US 8,752,683 B2
(45) Date of Patent: Jun. 17, 2014

(54) LIGHTWEIGHT, HIGH-STRENGTH LUGGAGE

(75) Inventor: Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 220 days.

(21) Appl. No.: 13/168,352

(22) Filed: Jun. 24, 2011

(65) Prior Publication Data

US 2012/0325606 A1 Dec. 27, 2012

(51) Int. Cl.
*A45C 7/00* (2006.01)

(52) U.S. Cl.
USPC ..... 190/115; 190/100; 190/103; 190/107; 206/509; 206/512; 206/562; 206/565; 206/594; 229/110; 229/114; 229/117.04; 229/143; 229/161

(58) Field of Classification Search
USPC ..... 190/100, 115, 103, 107; 206/509, 512, 206/562, 565, 594; 229/110, 114, 117.04, 229/143, 145, 148, 161–199
See application file for complete search history.

(56) References Cited

U.S. PATENT DOCUMENTS

| | | | | |
|---|---|---|---|---|
| 3,147,908 | A * | 9/1964 | Clemens | 206/512 |
| 6,604,617 | B2 | 8/2003 | Davis et al. | |
| 6,936,127 | B2 | 8/2005 | Fenton et al. | |
| 7,281,616 | B2 * | 10/2007 | Peterson et al. | 190/103 |
| 2010/0300825 | A1 * | 12/2010 | Nordstrom | 190/107 |
| 2012/0175207 | A1 * | 7/2012 | Scicluna | 190/107 |
| 2012/0325606 | A1 * | 12/2012 | Scicluna | 190/115 |

OTHER PUBLICATIONS

U.S. Appl. No. 13/005,318, filed Jan. 12, 2011, Scicluna.

* cited by examiner

*Primary Examiner* — Anthony Stashick
*Assistant Examiner* — Cynthia Collado
(74) *Attorney, Agent, or Firm* — Jon Fallon, Esq.; Michael P. Kochka, Esq.

(57) ABSTRACT

A piece of luggage including at least one section of a stiff shell material is provided. The at least one section of the stiff shell material defines a first face of the piece of luggage and has at least one corner. A portion of the at least one section has been removed to define at least one notch proximate the at least one corner. First and second edges of the at least one section adjacent the notch are folded inward relative an inner surface of the at least one section forming first and second sides. The first and second sides define second and third faces of the piece of luggage. The piece of luggage further includes at least one rigid corner piece secured to the first and second sides proximate the at least one notch.

31 Claims, 7 Drawing Sheets

LIGHTWEIGHT, HIGH-STRENGTH LUGGAGE

FIELD OF THE INVENTION

The disclosed subject matter relates to a system for lightweight, high-strength luggage or other bags, and for a method for the manufacture thereof.

BACKGROUND

In the luggage or bag field, there are generally two basic types of construction: (1) soft bags, in which the outer walls are made of a flexible material such as leather, vinyl, fabric, etc., and (2) hard bags, in which the outer walls are made of a hard plastic material such as polyvinyl chloride (PVC), polyethylene (PE), polypropylene (PP), etc. Soft bags, although they can be agreeable in appearance and light in weight, often do not afford adequate protection to the contents against external forces. For greater resistance to deformation, rigid internal frames have been provided in soft bags to maintain the shape of the bag. Such rigid internal frames, however, add significantly to manufacturing costs and also increase weight.

Hard bags have the advantage of resistance to deformation by external forces, which affords greater protection to the contents against damage. Such bags, however, tend to be less attractive in appearance or to the touch. They also tend to be heavier. Additionally, hard bags often require more complex manufacturing techniques, including the use of expensive molding techniques that require complex and expensive equipment, multiple heating and cooling steps, trimming steps, and cleaning steps to produce the luggage body. The amount of time the molding equipment is utilized to produce a piece of luggage is a significant factor in the cost of manufacturing that piece of luggage. Thus, the manufacture of hard bags can be expensive and time consuming compared to soft bags.

Items of luggage that attempt to combine certain features of hard and soft bags are described in U.S. Pat. No. 6,936,127 to Fenton et al. and U.S. Pat. No. 6,604,617 to Davis et al., the disclosures of which are incorporated in their entireties by reference herein. Nevertheless, there remains a need for a lightweight piece of luggage that has greater strength to resist deformation by external forces and can be produced with relatively simple and inexpensive manufacturing techniques.

SUMMARY OF THE INVENTION

The purpose and advantages of the disclosed subject matter will be set forth in and are apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a system for lightweight, high-strength luggage. A piece of luggage including at least one section of a stiff shell material is provided. The at least one section of the stiff shell material defines a first face of the piece of luggage and has at least one corner. A portion of the at least one section has been removed to define at least one notch proximate the at least one corner. First and second edges of the at least one section adjacent the notch are folded inward relative an inner surface of the at least one section forming first and second sides. The first and second sides define second and third faces of the piece of luggage. The piece of luggage further includes at least one rigid corner piece secured to the first and second sides proximate the at least one notch.

In some embodiments, the at least one section of the stiff shell material includes a woven polypropylene thermoplastic composite. The at least one section of the stiff shell material can include a plurality of layers of the woven polypropylene thermoplastic composite. For example, the at least one section of the stiff shell material can include six layers of the woven polypropylene thermoplastic composite, or any other suitable number of layers. The at least one section of the stiff shell material can be coated with a surface coating, and the surface can be, for example, a polyester film, or any other suitable material.

In some embodiments, the notch includes a V-shaped portion. The notch can also include portions with a U-shape, W-shape, or any other suitable shape. A portion of the notch can have a semicircular shape furthest from the at least one corner. The notch can also include an arcuate portion, and the notch can have a substantially semicircular portion furthest from the at least one corner.

In some embodiments, the first side can be secured to the second side by stitching together the first and second sides proximate first and second edges of the notch. The piece of luggage can include a reinforcement corner piece of the stiff shell material overlapping the first and second edges of the notch and secured to the first and second sides.

In some embodiments, third and fourth edges of the at least one section of the stiff shell material adjacent a second notch can be folded inward relative the inner surface forming third and fourth sides. The third and fourth sides can define fourth and fifth faces of the piece of luggage. The at least one section of the stiff shell material can be further folded to define a sixth face of the piece of luggage.

A second section of the stiff shell material can also define a sixth face of the piece of luggage. The second section of the stiff shell material can have four edges folded inward relative an inner surface of the second section to form four sides. The four sides can each be securable to a respective one of the first, second, third, and fourth sides of the at least one section to further define the second, third, fourth, and fifth faces of the piece of luggage, respectively. One of the four sides of the at least one section can be permanently secured to the respective side of the second section and can form a hinge. For example, the one of the four sides of the at least one section can be permanently secured to the respective side of the second section by a gusset, or any other suitable mechanism. At least one of the four sides of the at least one section can be releasably secured to at least one respective side of the second section. For example, the at least one releasably secured side can be releasably secured by a zipper.

In some embodiments, the at least one rigid corner piece is further secured to the first face. The at least one rigid corner piece can be secured using fasteners, or any other suitable mechanism. The at least one rigid corner piece can be secured to the inner surface of the at least one section of the stiff shell material. The at least one rigid corner piece can also be secured to an outer surface of the at least one section of the stiff shell material. The at least one rigid corner piece can be secured to an inner fastening piece disposed on the inner surface of the at least one section of the stiff shell material, with the at least one section disposed between the inner fastening piece and the at least one rigid corner piece.

In some embodiments, the at least one rigid corner piece can be connected to a second rigid corner piece by a support structure. The support structure can be integral with one or more of the at least one rigid corner pieces. The support structure can be secured to the inner surface of the at least one section of the stiff shell material, and the support structure can be secured to an outer surface of the at least one section of the stiff shell material. One of the at least one rigid corner pieces can include an engagement feature to engage a wheel.

In some embodiments, the piece of luggage includes four rigid corner pieces. The piece of luggage can also include eight rigid corner pieces, or any other suitable number of rigid corner pieces. The piece of luggage can also include a retractable handle.

The disclosed subject matter also includes a method of assembling a piece of luggage. The method includes providing a section of the stiff shell material defining a first face of the piece of luggage and having a corner. The method also includes removing a portion of the section of stiff material proximate the corner to define a notch. The method includes folding first and second edges of the section to form first and second sides, the first and second sides defining second and third faces of the piece of luggage. The method also includes securing a rigid corner piece to the first and second sides proximate the notch. The piece of luggage can include any of the features described herein above.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION

Figure 1:
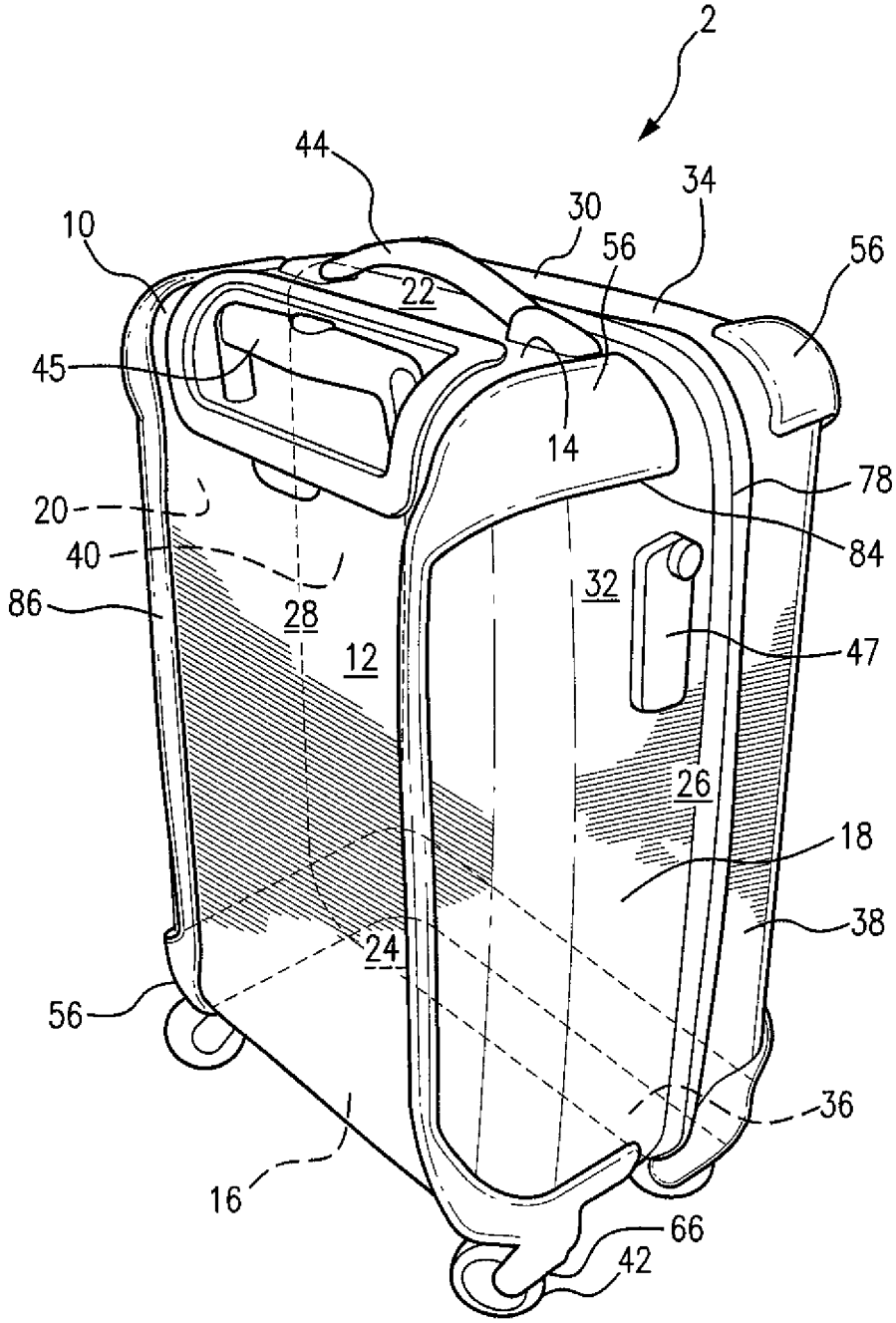
FIG. 1 is a schematic three-quarter back pictorial view of a first exemplary embodiment of a piece of luggage according to the disclosed subject matter, with portions cut away.
Figure 2:
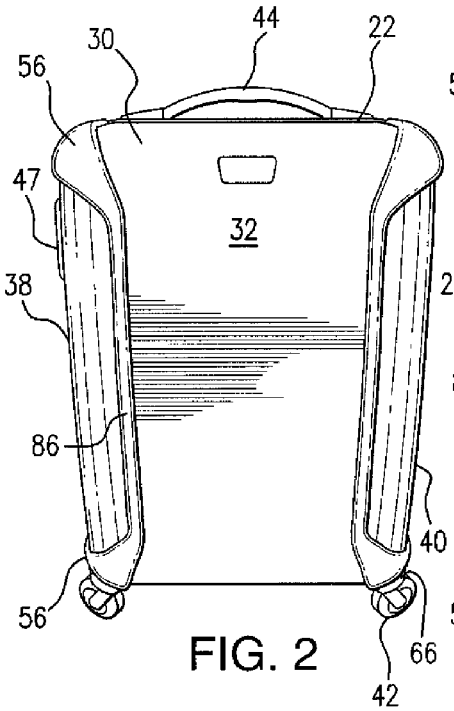
FIG. 2 is a front view of the piece of luggage of FIG. 1.
Figure 3:
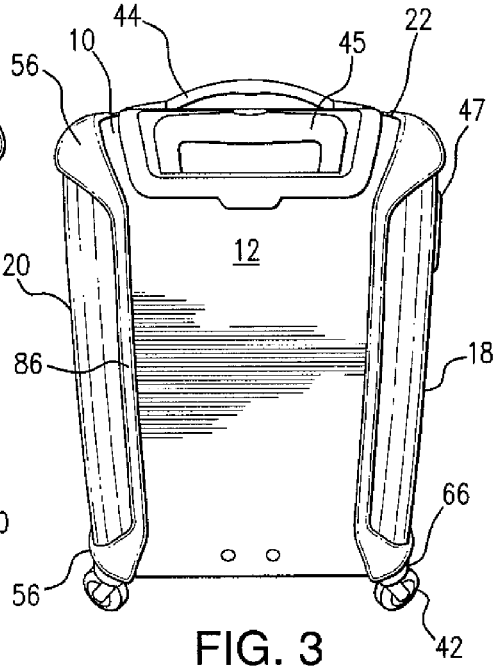
FIG. 3 is a back view of the piece of luggage of FIG. 1.

Reference will now be made in detail to the exemplary embodiments of the disclosed subject matter, an example of which is illustrated in the accompanying drawings. The method and corresponding steps of the disclosed subject matter will be described in conjunction with the detailed description of the system.

As disclosed herein, the devices and methods presented can be used for lightweight, high-strength luggage. In particular, the disclosed subject matter is particularly suited for making a piece of lightweight, high-strength luggage.

For the purpose of explanation and illustration, and not limitation, an exemplary embodiment is shown in FIGS. 1-6. Particularly and as illustrated, the embodiment shown in FIGS. 1-6 can be of any suitable specific construction in terms of materials, manner of assembly, and configurations of the parts. The luggage 2, as shown in FIGS. 1-5, includes a rear section 10 made of a stiff shell material, such as a woven polypropylene (PP) thermoplastic composite having characteristics described herein below. The rear section 10 can have a substantially rigid main panel defining a rear face 12 of the luggage 2, and side panels 14, 16, 18, 20, which can partially define top 22, bottom 24, left side 26, and right side 28 faces of the luggage 2. The luggage 2 can also have a front shell section 30, which can have a substantially rigid main panel, defining a front face 32 of the luggage, and side panels 34, 36, 38, 40, which can further define the top 22, bottom, 24, left side 26, and right side 28 faces of the luggage 2.

Figure 7:
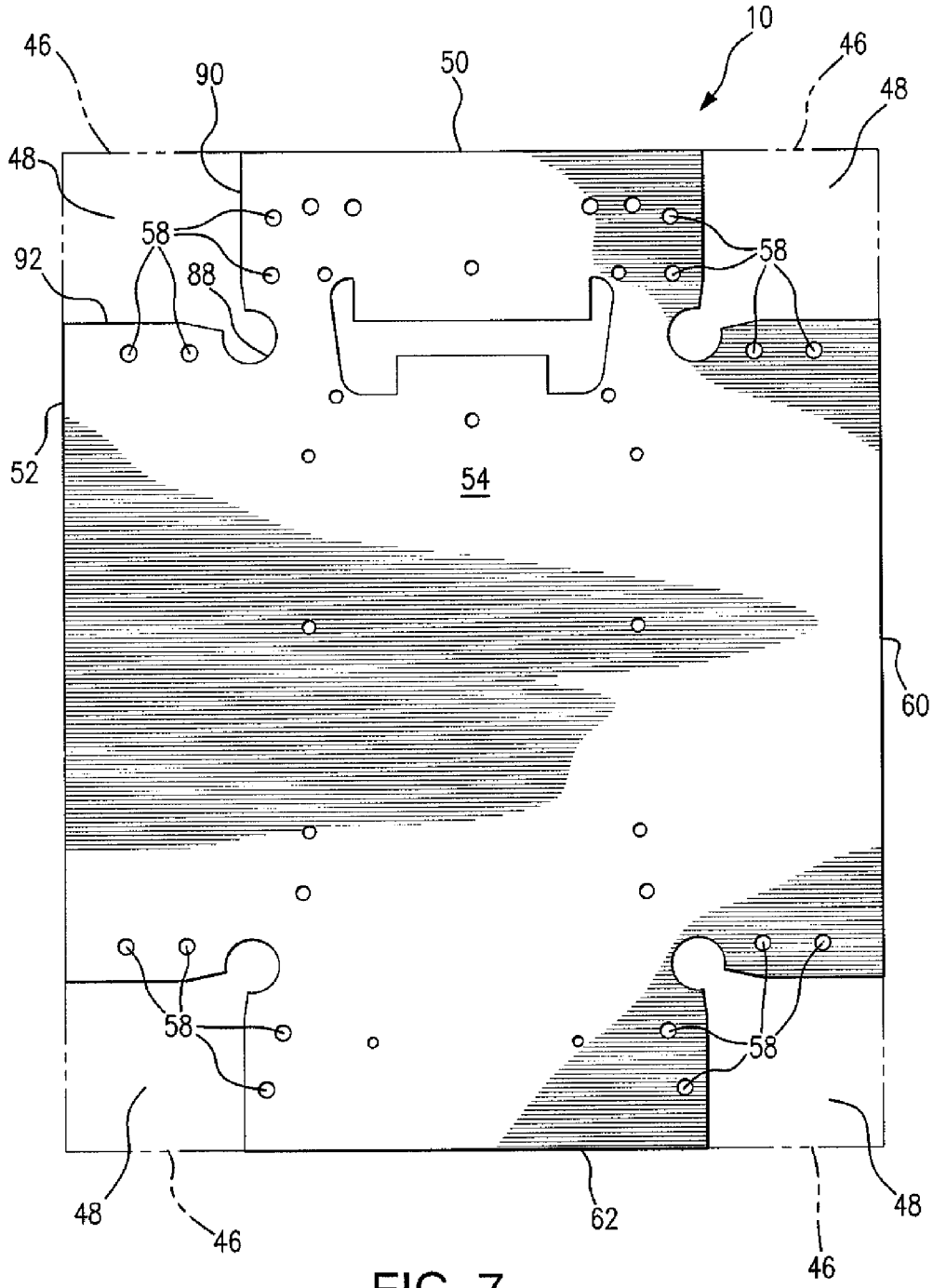
FIG. 7 is a plan view of a first section of the stiff shell material according to the first exemplary embodiment of the disclosed subject matter.
Figure 8:
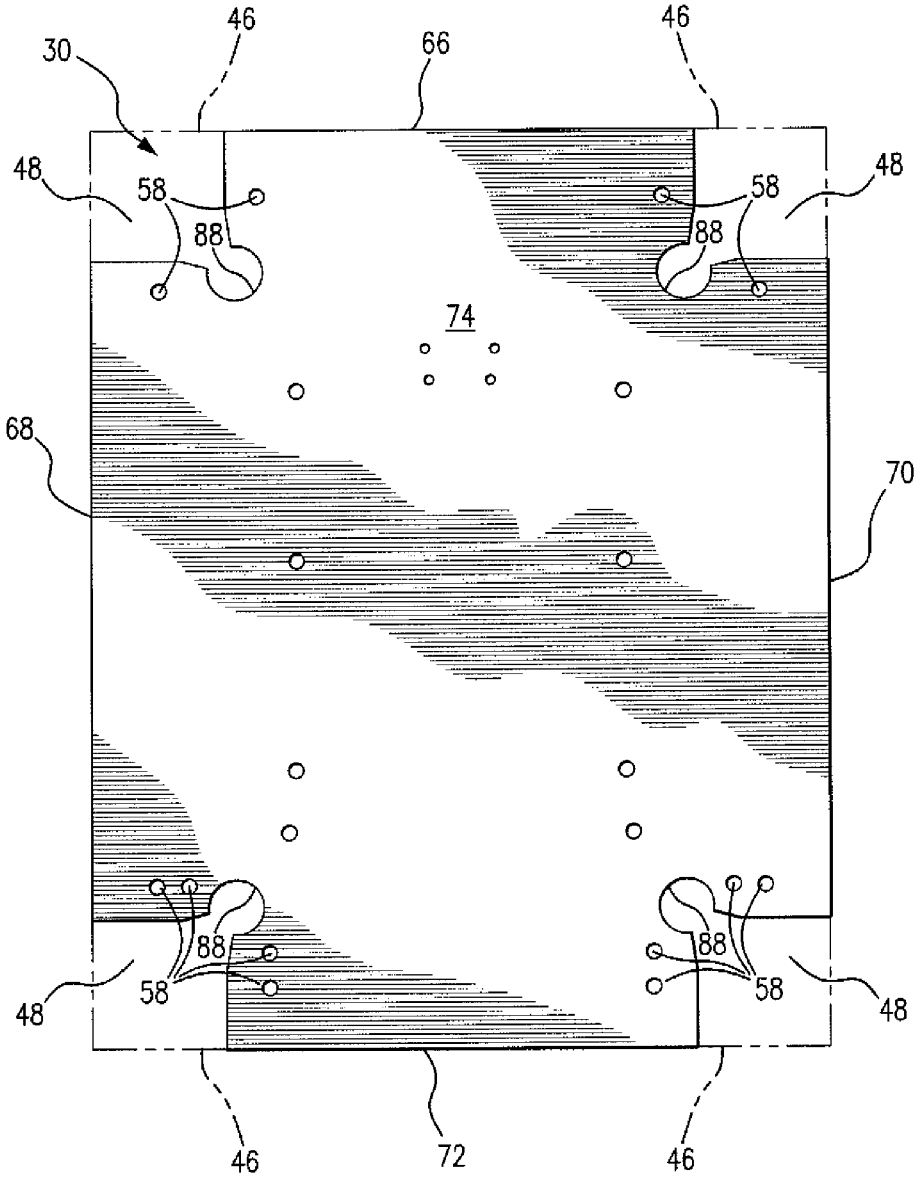
FIG. 8 is a plan view of a second section of the stiff shell material according to the first exemplary embodiment of disclosed subject matter.

For the purpose of explanation and illustration, and not limitation, with reference to the exemplary embodiment shown in FIGS. 7 and 8, the rear and front sections 10, 30 can be provided as sheets of the stiff shell material. The rear section 10 has a corner 46 in which a portion has been removed defining a notch 48. In forming the luggage 2, edges 50, 52 of the rear section 10 adjacent the notch 48 are folded inward relative inner surface 54 forming sides 14, 18, which are shown in FIG. 1, for example and without limitation. As shown in FIG. 1, for example and without limitation, sides 14, 18 define the rear section 10 portions of the top and left faces 22, 26 of the luggage 2. Sides 14 and 18 can abut proximate edges 90 and 92 of rear section 10 and further can be stitched, or otherwise joined, proximate the edges 90, 92. Further, sides 14 and 18 can partially overlap when secured together proximate edges 90, 92, and an additional piece of the stiff shell material can be cut to fit and be secured about the joined edges 90, 92 for additional reinforcement.

Figure 6:
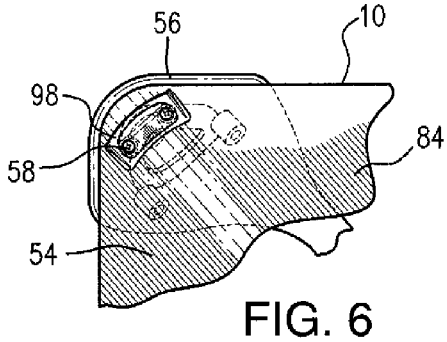
FIG. 6 is a cut-away view of an interior portion of the piece of luggage showing an inner fastening piece secured to a rigid corner piece according to an exemplary embodiment of the disclosed subject matter.

The sides 14, 18 of the rear section 10 are secured to a rigid corner piece 56. The sides 14, 18 can be secured by attaching fasteners to the rigid corner piece 56 through one or more of the holes 58 (as shown in FIG. 7, for example and without limitation) in the rear section 10 adjacent the notch 48. Alternatively, the sides 14, 18 can be secured to the rigid corner piece 56 by pins, staples, glue, or any other suitable fastening mechanism. The rigid corner piece 56 can be secured to the inner surface 54 of the rear section 10, or alternatively, the rigid corner piece 56 can be secured to an outer surface 84 of the rear section 10. Additionally or alternatively, the rigid corner piece 56 can be secured to an inner fastening piece 98 disposed on the inner surface 54, with rear section 10 disposed between the rigid corner piece 56 and the inner fastening piece 98 (as shown in FIG. 6, for example and without limitation). Further, rigid corner piece 56 can be secured to rear face 12 by attaching additional fasteners to the rigid corner piece 56 through additional holes 58 located on the rear section 10 (as shown in FIG. 7, for example and without limitation).

Figure 11:
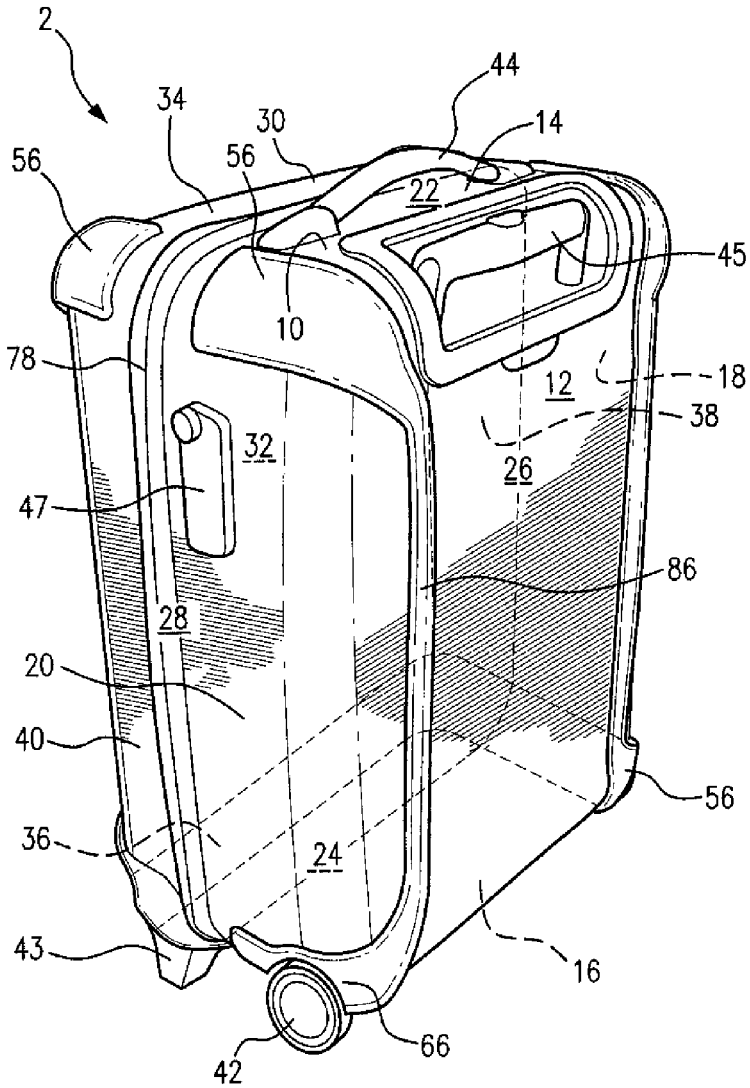
FIG. 11 is a schematic three-quarter back pictorial view of a second exemplary embodiment of a piece of luggage according to the disclosed subject matter, with portions cut away.

As most travel luggage being marketed currently is of the towable, wheeled type, in practice for such luggage items, the bottom 24 face, or any other suitable portion of the luggage 2, can be configured to accept wheels 42, and the top 22 and bottom 24 faces, or any other suitable portion of the luggage 2, can be configured to accept a carrying handle 44, a retractable handle 45, a lock 47, and the like. A rigid corner piece 56 can include an engagement feature 66 to engage a wheel 42. The engagement feature can be a socket, bore hole, or other suitable mechanism for engaging a wheel assembly 42. In a two-wheel configuration, feet 43 can be secured opposite the wheels on the bottom face 24, as shown in FIG. 11, for example and without limitation, and can be secured to a rigid corner piece 56. Additionally, in any configuration, the wheels 42 can be swivel wheels, as shown in FIG. 1, for example and without limitation, or can be fixed wheels, as shown in FIG. 11, for example and without limitation, or can be any other suitable type of wheel for wheeled luggage.

Rigid corner piece 56 can be secured to one another by support structures 86. Support structures 86 can also be secured to inner surface 54 of the rear section 10, or alternatively, support structures 86 can be secured to outer surface 84 of the rear section 10. Likewise, support structures 86 can be secured to front section 30. Support structures 86 can be integral with rigid corner pieces 56, and can secure pairs of rigid corner pieces 56 opposed along any edges, for example, vertically, as shown in FIG. 1, for example and without limitation, or horizontally, or diagonally across any faces of the luggage 2.

For the purposes of illustration and not limitation, in the exemplary embodiment of FIG. 1, a piece of luggage 2 having eight rigid corner pieces 56 is shown; however, it is contemplated that a piece of luggage 2 can have one, two, four, or any other suitable number of rigid corner pieces 56. Additionally, any number, size, and shape of support structure 86 can be included throughout luggage 2 to provide additional support and resist deformation of the rear section 10 and/or front section 30.

As shown in FIG. 7, for example and without limitation, the rear section 10 can have further edges 60, 62 adjacent a notch 48. The further edges 60, 62 can be folded inward relative inner surface piece 56 forming further sides 16, 20, which are shown in FIG. 1, for example and without limitation. Further sides 16, 20 can be secured to a rigid corner piece 56 in any manner described above. As shown in FIG. 1, for example and without limitation, sides 16, 20 can define the rear section 10 portions of the bottom and right faces 24, 28 of the luggage 2.

In an exemplary embodiment, luggage 2 can have a front section 30 that defines the front face 32 of the luggage 2 (as shown in FIG. 1, for example and without limitation). As shown in FIG. 8, for example and without limitation, front section 30 can have four edges 66, 68, 70, 72. The four edges 66, 68, 70, 72 of front section 30 can be folded inward relative an inner surface 74 of the front section 30 to form four sides 34, 36, 38, 40, as best shown in FIG. 1, for example and without limitation. Any of the adjacent sides 34, 36, 38, 40 can be secured to a rigid corner piece 56 in any manner described above. The four sides 34, 36, 38, 40 of the front section 30 can each further be securable to a respective one of the four sides 14, 16, 18, 20 of the rear section 10. In this manner, the four sides 34, 36, 38, 40 further define the top 22, bottom, 24, left 26, and right 28 sides of the luggage 2.

Figure 4:
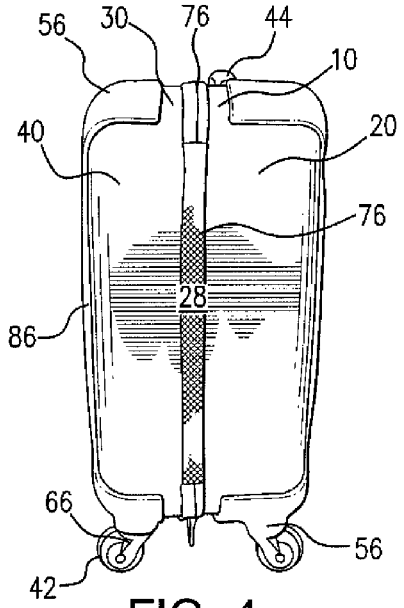
FIG. 4 is a right side view of the piece of luggage of FIG. 1, the left side view being substantially a mirror image of the right side view.
Figure 5:
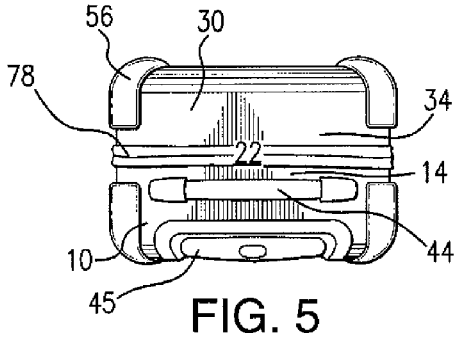
FIG. 5 is a top view of the piece of luggage of FIG. 1.

To facilitate opening and closing of the luggage 2, for example and without limitation, side 20 of the rear section 10 can be permanently secured to the respective side 40 of the front section 30 and can form a hinge. Side 20 of the rear section 10 can be permanently secured to respective side 40 of the front section 30, for example and without limitation, by forming a gusset 76 of material (as best shown in FIG. 4, for example and without limitation) that can function as a hinge to allow the rear section 10 and front section 30 to open apart from each other and allow a user to access the interior of the luggage 2. The gusset 76 can be made of fabric, or any other suitable flexible material. Alternatively, a hinge can be formed by a scoring, by a hinged bracket joint, or any other suitable means.

Rear section 10 and front section 30 can also be formed from a single sheet of the stiff shell material by, for example, joining the two sections 10, 30 at edges 60 and 68. The sheet of joined sections 10, 30 can later be cut, or otherwise separated, along edges 60 and 68 to provide the patterns shown in FIGS. 7 and 8, for example and without limitation. As a further alternative, the edges 60, 68 can be modified to form a hinge, for example by scoring or otherwise deforming the joined edges 60, 68.

To allow selective opening and closing of the luggage 2, for example and without limitation, sides 14, 16, 18 of the rear section 10 can be releasably secured to respective sides 34, 36, 38 of the front section. For example and without limitation, the sides 14, 16, 18 can be releasably secured to sides 34, 36, 38 by a zipper 78 to allow a user to open and close to luggage 2 by unzipping and zipping the luggage 2. Additionally or alternatively, the luggage 2 can be releasably opened and closed by way of a latch, hook, or any other suitable means. Further, a key lock, combination lock, or the like can be added to the above securing mechanisms to prevent unauthorized access to the interior of the luggage 2.

In another exemplary embodiment, for the purpose of illustration and not limitation, the rear section 10 can be further folded to form a top cover to define front face 32 of the luggage 2. In this embodiment, zipper 78 can releasably secure the top cover to the remaining faces of the luggage 2, for example and without limitation, faces 22, 26, 28 to allow a user to access the interior of the luggage 2, and an interface between face 32 and face 24 can act as a hinge. While it is contemplated that the top cover can be formed by the rear section 10, alternatively, the top cover can be formed by a separate piece of material, which may the same type of material as rear section 10, or any other suitable material.

In any of the embodiments described herein, rear section 10 and/or front section 30 are made of a stiff shell material. For example and without limitation, as discussed above, the stiff shell material can be a woven polypropylene (PP) thermoplastic composite, such as Tegris™ polypropylene moldable fabric manufactured by Milliken (available at http://www.milliken.com/MFT); however, a person having ordinary skill in the art will recognize that any suitable fabric, plastic, metal, or any other suitable material having a high stiffness-to-weight ratio and high impact resistance can be used.

Figure 12:
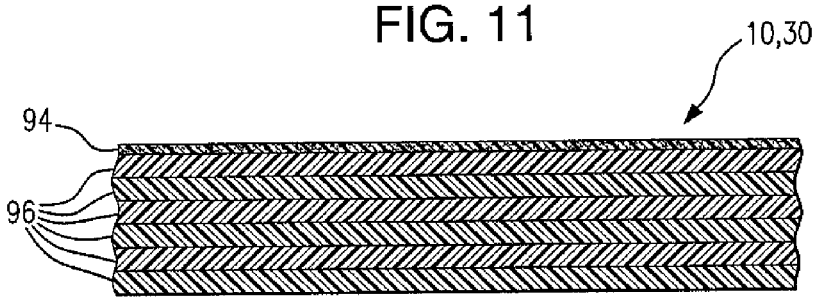
FIG. 12 is a cross section of a section of the stiff shell material in according to an exemplary embodiment of the disclosed subject matter.

As shown in FIG. 12, for example and without limitation, rear section 10 and/or front section 30 of the stiff shell material can have a plurality of layers. For example and without limitation, it is contemplated that a single sheet of the shell material of rear section 10 and/or front section 30 can have six layers 96 of woven polypropylene (PP) thermoplastic composite. However, any suitable number of layers of woven polypropylene (PP) thermoplastic composite, or other suitable material, can be used. Additionally, rear section 10 and/ or front section 30 of the stiff shell material can have a surface coating 94, for example and without limitation, to enhance cosmetic effects, such as scratch resistance or to alter the color of the underlying material. For example and without limitation, the surface coating 94 can be a polyester film, such as polyethylene terephthalate (PET), or any other suitable material. The use of the shell material, such as woven polypropylene (PP) thermoplastic composite, for rear section 10 and front section 30 can produce sections that are bendable, yet have memory to prevent permanent deformities due to impacts. Additionally, the sheets of shell material can be stitched for added versatility.

As shown in FIGS. 7-10, for example and without limitation, the rear section 10 and front section 30 can be provided as a sheet of material, such as woven polypropylene (PP) thermoplastic composite having the characteristics described herein above. The corners 46 can each have a portion removed to form notches 48. The shape of the notches 48 can vary depending on the desired characteristics of the luggage 2. For example and without limitation, the notches 48 can have the edges 90 and 92 be substantially perpendicular (as shown in FIGS. 7-10, for example an without limitation). Additionally or alternatively, the notches 48 can include a portion having a semicircular shape 88, and the semicircular shape 88 can be towards the interior of the sheet, furthest away from the respective corner 46. The shape of the notches 48 can differ, for example, to accommodate additional or fewer wheels 42. The semicircular shape 88 can, for example, aid in mating sides 14 and 18 to the rigid corner piece 56. For example and without limitation, it is contemplated that the luggage 2 can accommodate four wheels (as shown in FIG. 1) or two wheels (as shown in FIG. 11). Alternatively, some of the notches 48 can have portions that are U-shaped, V-shaped, W-shaped, or any other suitable shape.

The shape of the notches 48, holes 58, and any other features of the rear section 10 and/or front section 30 can be formed by cutting, drilling, etching, trimming, or any other suitable method for removing portions of a sheet of material described herein. The preparation of the rear section 10 and front section 30 of the stiff shell material in this manner can eliminate the need for expensive molding processes, such as those required with traditional manufacturing methods, yet can provide shell sections 10, 30 that have high stiffness-to-weight ratio and high impact resistance.

Figure 9:
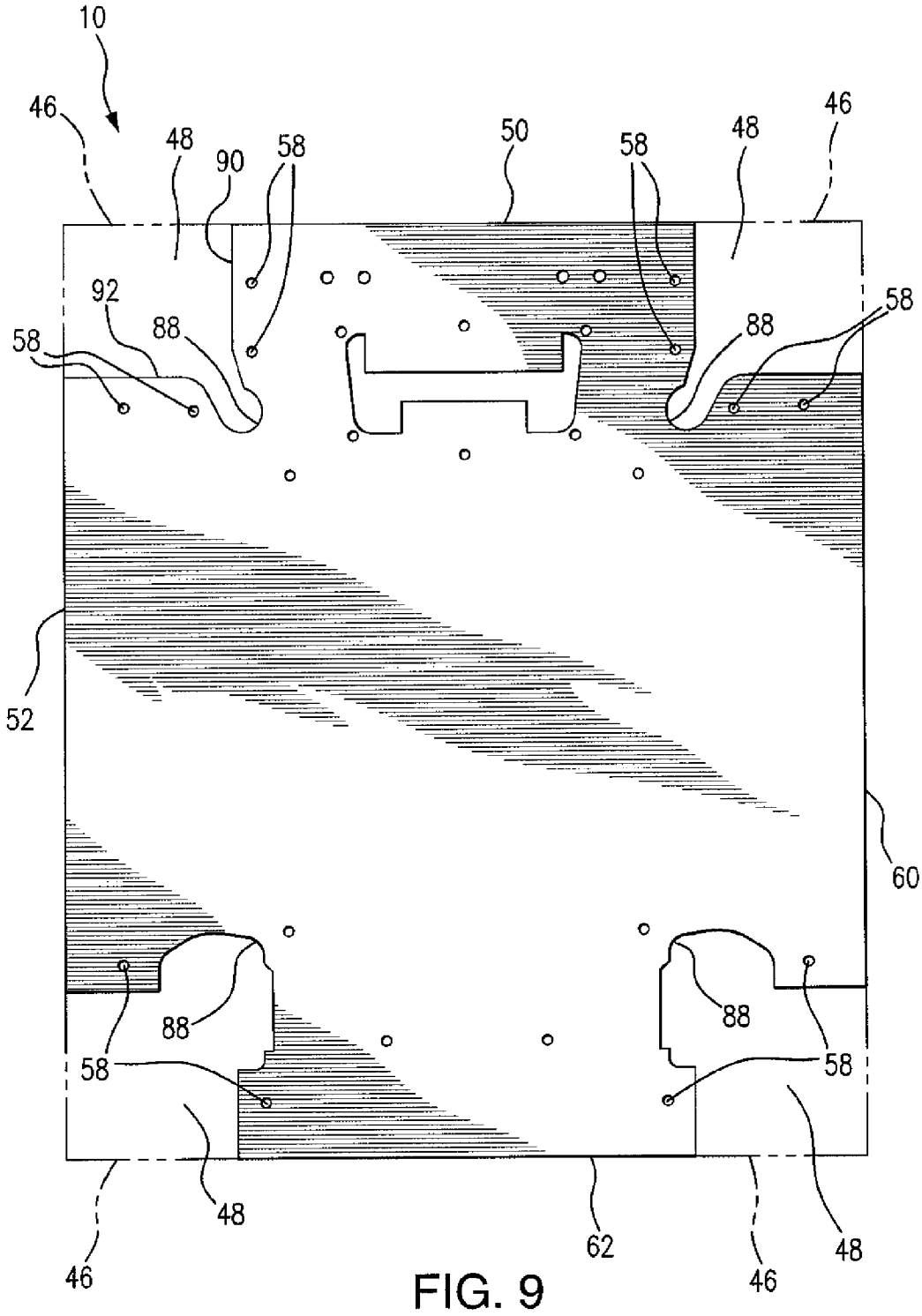
FIG. 9 is a plan view of a first section of the stiff shell material according to a second exemplary embodiment of the disclosed subject matter.
Figure 10:
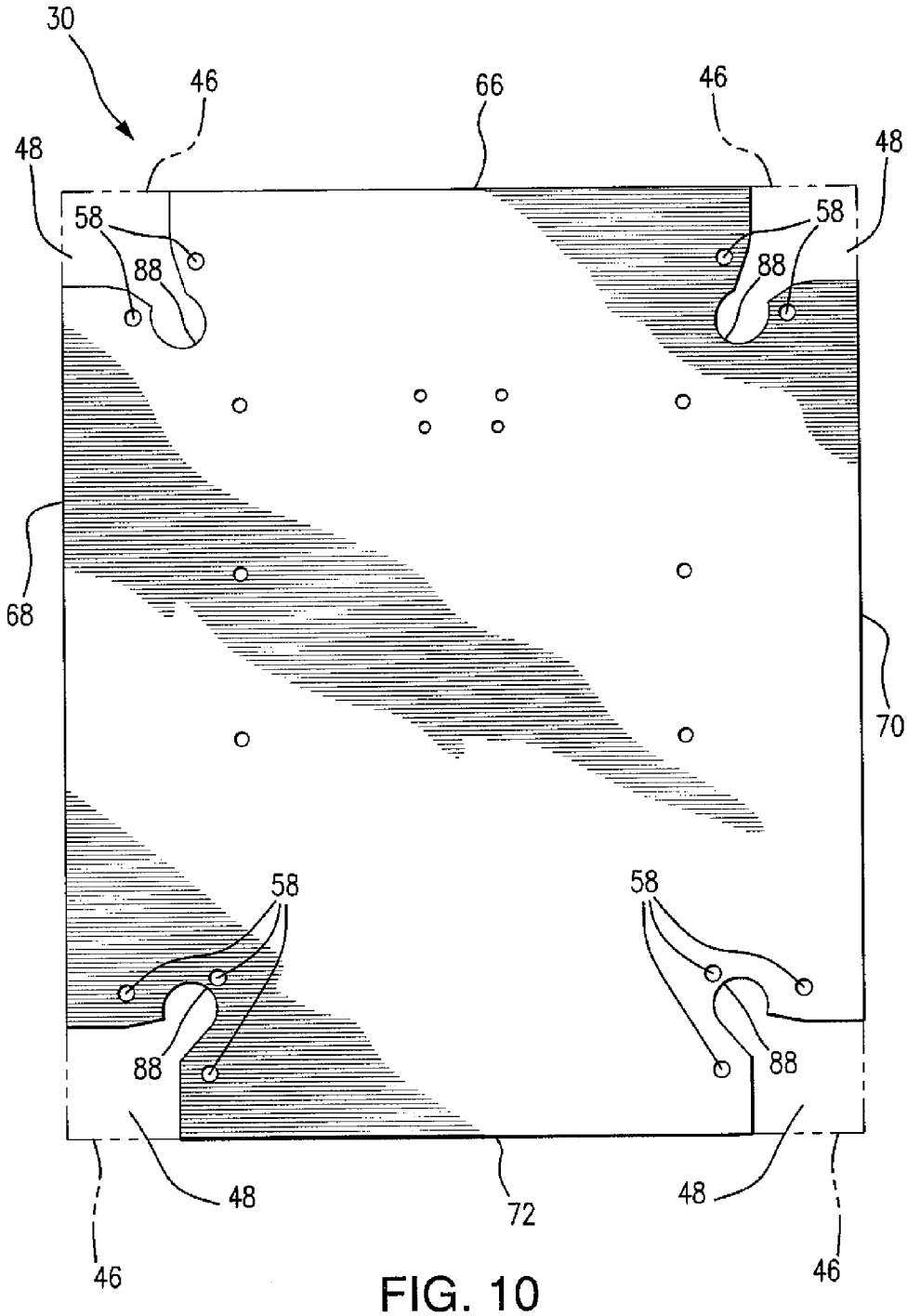
FIG. 10 is a plan view of a second section of the stiff shell material according to the second exemplary embodiment of the disclosed subject matter.

In the four-wheel configuration, rear section 10 and front section 30, as shown in FIGS. 7 and 8, for example and without limitation, can be provided. In the two-wheel configuration, rear section 10 and front section 30, as shown in FIGS. 9 and 10, for example and without limitation, can be provided.

As shown in FIGS. 1 and 11, for example and without limitation, luggage 2 can be provided with a retractable handle 45. Additionally, a luggage expansion system (not shown) can be incorporated into luggage 2 to allow a user to increase or decrease the interior volume of the luggage 2. Examples of expandable pieces of luggage with substantially rigid frames are shown and described in U.S. Pat. No. 7,281,616 to Peterson et al. and U.S. patent application Ser. No. 13/005,318 to Scicluna, the disclosures of which are incorporated in their entireties by reference herein.

In accordance with another aspect of the disclosed subject matter, a method of assembling a piece of luggage 2 is provided. The method includes providing a rear section 10 of the stiff shell material defining a rear face 12 of the piece of luggage 2 and having a corner 46. The method also includes removing a portion of the rear section 10 of the stiff shell material proximate the corner 46 to define a notch 48. The method also includes folding edges 50, 52 of the rear section 10 to form sides 14, 18. The sides 14, 18 define top 22 and left side 26 faces of the luggage 2. The method also includes securing a rigid corner piece 56 to the sides 14, 18 proximate the notch 48. The luggage 2 can include any of the features described herein above.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed is:

1. A piece of luggage, comprising:

at least one section of a stiff shell material defining a first face of the piece of luggage and having at least one corner wherein a portion of the at least one section has been removed forming at least one notch proximate the at least one corner, wherein first and second edges of the at least one section adjacent the notch are folded inward relative an inner surface of the at least one section forming first and second sides, the first and second sides defining second and third faces of the piece of luggage; and at least one rigid corner piece secured to the first and second sides proximate the at least one notch;

wherein third and fourth edges of the at least one section of the stiff shell material adjacent a second notch are folded inward relative the inner surface forming third and fourth sides, the third and fourth sides defining fourth and fifth faces of the piece of luggage; and wherein the at least one section of the stiff shell material is further folded to define a sixth face of the piece of luggage.

2. The piece of luggage of claim 1, wherein the at least one section of the stiff shell material comprises a woven polypropylene thermoplastic composite.

3. The piece of luggage of claim 2, wherein the at least one section of the stiff shell material comprises a plurality of layers of a woven polypropylene thermoplastic composite.

4. The piece of luggage of claim 3, wherein the at least one section of the stiff shell material comprises six layers of the woven polypropylene thermoplastic composite.

5. The piece of luggage of claim 1, wherein the at least one section of the stiff shell material is coated with a surface coating.

6. The piece of luggage of claim 5, wherein the surface coating is a polyester film.

7. The piece of luggage of claim 1, wherein the notch includes a V-shaped portion.

8. The piece of luggage of claim 1, wherein the notch includes a U-shaped portion.

9. The piece of luggage of claim 1, wherein the notch includes an arcuate portion.

10. The piece of luggage of claim 1, wherein a portion of the notch has a substantially semicircular portion furthest from the at least one corner.

11. The piece of luggage of claim 1, wherein the first side is secured to the second side by stitching together the first and second sides proximate first and second edges of the notch.

12. The piece of luggage of claim 11, further comprising a reinforcement corner piece of the stiff shell material overlapping the first and second edges of the notch and secured to the first and second sides.

13. The piece of luggage of claim 1, wherein a second section of the stiff shell material defines a seventh face of the piece of luggage, the second section of the stiff shell material having four edges folded inward relative an inner surface of the second section to form four sides, the four sides each being securable to a respective one of the first, second, third, and fourth sides of the at least one section to further define the second, third, fourth, and fifth faces of the piece of luggage, respectively.

14. The piece of luggage of claim 13, wherein one of the four sides of the at least one section is permanently secured to the respective side of the second section and forms a hinge.

15. The piece of luggage of claim 14, wherein the one of the four sides of the at least one section is permanently secured to the respective side of the second section by a gusset.

16. The piece of luggage of claim 13, wherein at least one of the four sides of the at least one section are releasably secured to at least one respective sides of the second section.

17. The piece of luggage of claim 16, wherein the at least one releasably secured side is releasably secured by a zipper.

18. The piece of luggage of claim 1, wherein the at least one rigid corner piece is further secured to the first face.

19. The piece of luggage of claim 1, wherein the at least one rigid corner piece is secured using fasteners.

20. The piece of luggage of claim 1, wherein the at least one rigid corner piece is secured to the inner surface of the at least one section of the stiff shell material.

21. The piece of luggage of claim 1, wherein the at least one rigid corner piece is secured to an outer surface of the at least one section of the stiff shell material.

22. The piece of luggage of claim 1, wherein the at least one rigid corner piece is secured to an inner fastening piece disposed on the inner surface of the at least one section of the stiff shell material, with the at least one section disposed between the inner fastening piece and the at least one rigid corner piece.

23. The piece of luggage of claim 1, wherein the at least one rigid corner piece is connected to a second rigid corner piece by a support structure.

24. The piece of luggage of claim 23, wherein the support structure is secured to the inner surface of the at least one section of the stiff shell material.

25. The piece of luggage of claim 23, wherein the support structure is secured to an outer surface of the at least one section of the stiff shell material.

26. The piece of luggage of claim 23, wherein the support structure is integral with one or more of the at least one corner pieces.

27. The piece of luggage of claim 1, wherein one of the at least one rigid corner pieces comprises an engagement feature to engage a wheel.

28. The piece of luggage of claim 1, wherein the piece of luggage comprises four rigid corner pieces.

29. The piece of luggage of claim 1, wherein the piece of luggage comprises eight rigid corner pieces.

30. The piece of luggage of claim 1, the piece of luggage further comprising a retractable handle.

31. A method of assembling a piece of luggage, comprising:

providing a section of a stiff shell material defining a first face of the piece of luggage and having a corner;

removing a portion of the section of the stiff shell material proximate the corner to define a notch;

folding first and second edges of the section to form first and second sides, the first and second sides defining second and third faces of the piece of luggage;

folding third and fourth edges of the section to form third and fourth sides, the third and fourth sides defining fourth and fifth faces of the piece of luggage;

folding the section to define a sixth face; and securing a rigid corner piece to the first and second sides proximate the notch.

* * * * *